United States Patent [19]

LaFlamme

[11] Patent Number: 4,742,597

[45] Date of Patent: May 10, 1988

[54] PAINT ROLLER APPARATUS

[76] Inventor: Daniel P. LaFlamme, 13021 26th NE., Apt K-101, Bellevue, Wash. 98005

[21] Appl. No.: 82,539

[22] Filed: Aug. 7, 1987

[51] Int. Cl.[4] ..... B05C 17/02

[52] U.S. Cl. ..... 15/244.2; 15/230.11; 29/110.5

[58] Field of Search ..... 15/230.11, 244 A; 29/110, 110.5, 111, 121.1, 121.5, 121.7, 124, 125, 130

[56] References Cited

U.S. PATENT DOCUMENTS 2,823,402 2/1958 Phillips ..... 29/120 X 2,887,711 5/1959 Hutchinson ..... 15/230

3,082,459 3/1963 Johnson ..... 15/230

3,955,260 5/1976 Sherden ..... 29/121 R

*Primary Examiner*—Edward L. Roberts

*Attorney, Agent, or Firm*—Henderson & Sturm

[57] ABSTRACT

A paint roller apparatus having a cylindrical paint roller with a porous outer surface thereon disposed for rotation about a longitudinal axis. The apparatus has a handle and a mechanism for rotatably attaching the cylindrical paint roller to the handle about the longitudinal axis. A pair of porous annular foam members are disposed around and frictionally attached to the outer surface of the roller for extending into grooves in a surface being painted.

3 Claims, 1 Drawing Sheet

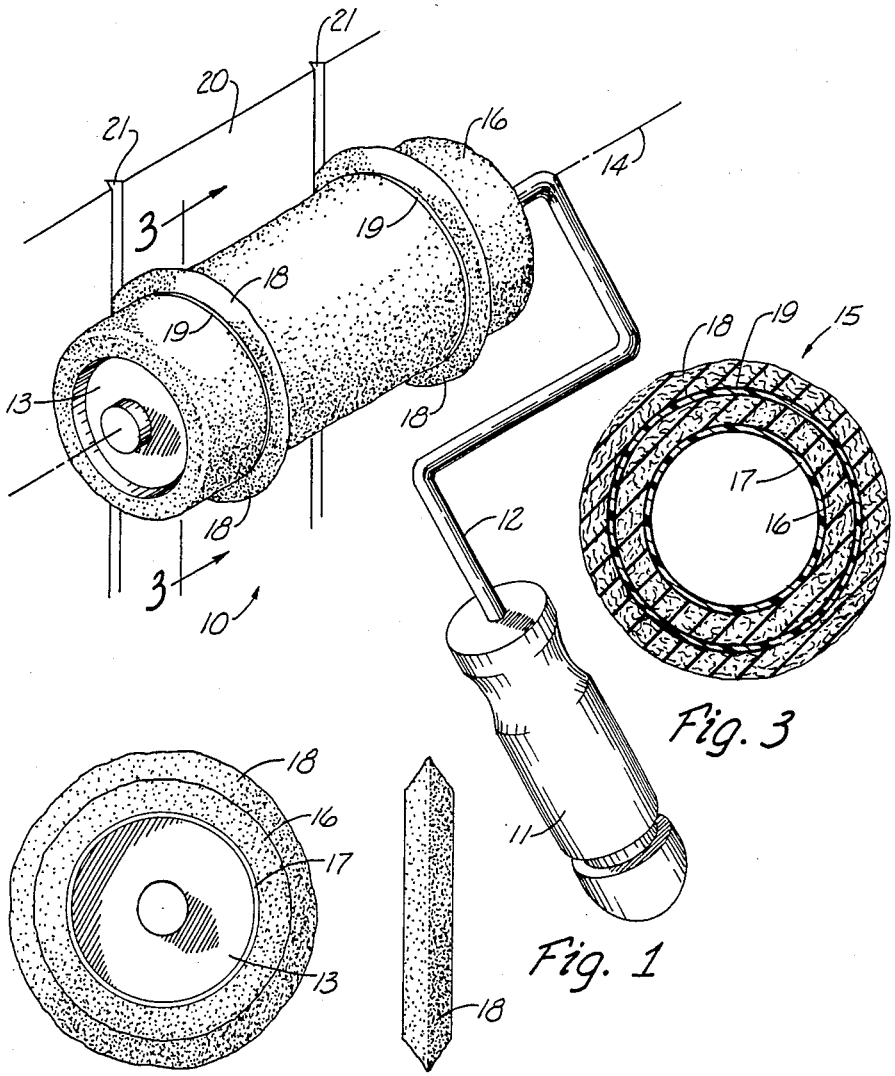
Fig. 1
Fig. 3
Fig. 2
Fig. 5
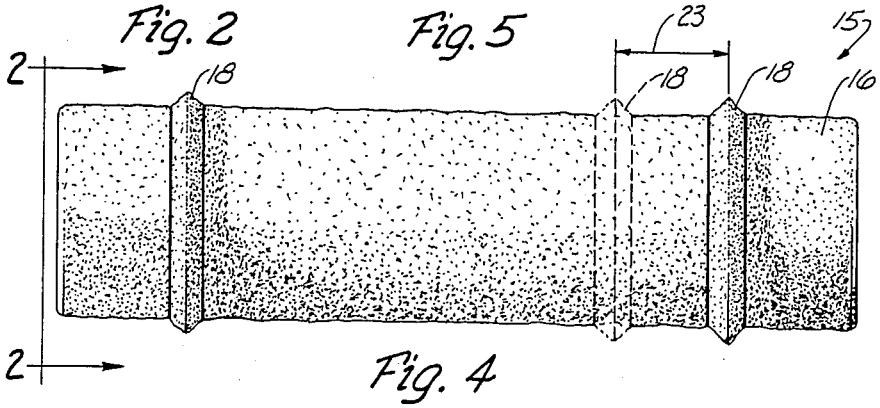
Fig. 4

PAINT ROLLER APPARATUS

TECHNICAL FIELD

The present invention relates generally to painting rollers and more particularly to a painting roller apparatus having adjustable ridges thereon for extending into grooves in siding or the like.

BACKGROUND ART

When painting house siding or paneling having grooves therein, it has heretofore been somewhat impractical to use a paint roller, because the paint roller would paint the flat surface but would not cover the grooves with paint. Consequently, it was necessary to first paint the grooves with a brush and then continue to paint the flat surface with either a brush or a roller.

Consequently, there has developed a need for a paint roller which is adaptable to permit the painting of the grooves in siding at the same that the flat surface of the siding is being painted.

U.S. Pat. No. 3,082,459 to Johnson shows a resin roller for rolling out reinforced plastics and fiberglass. This structure is not, however, useful for painting house siding with grooves therein. Similarly, U.S. Pat. No. 3,955,260 to Sherden shows a paint roller with a plurality of projections thereon for painting ceilings with textured paint. U.S. Pat. No. 2,823,402 is a paint roller structure for simultaneously painting a side and one or both edges of a picket fence of a predetermined width. This structure is not adaptable, however, for painting house siding. U.S. Pat. No. 2,887,711 shows a wax applicator for applying wax to skis. This roller does include an annular ridge thereon for extending into a groove in a ski, but such annular ridge does not appear to be adjustably mounted on the roller and there is only one ridge on such roller so that it would be impractical to use such a roller for painting ridged siding or the like.

DISCLOSURE OF THE INVENTION

The present invention relates to a paint roller apparatus having a cylindrical paint roller with a porous outer surface thereon disposed for rotation about a longitudinal axis. The apparatus has a handle and a mechanism for rotatably attaching the cylindrical paint roller to the handle about the longitudinal axis. A pair of porous annular foam members are disposed around and frictionally attached to the outer surface of the roller for extending into grooves in a surface being painted.

An object of the present invention is to provide an improved painting roller.

Another object of the invention is to provide a painting roller which will simultaneously paint the grooves and the flat surfaces on siding.

Another object of the present invention is to provide a paint roller apparatus of the aforementioned type which has adjustable annular members disposed around a cylindrical roller so that the roller apparatus is adaptable to paint siding having grooves of different relative spacing between the grooves.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of a paint roller constructed in accordance with the present invention shown in use painting the surface of house siding having a pair of grooves therein;

FIG. 2 is an end view of the roller of the preferred embodiment;

FIG. 3 is a cross-sectional view taken along line 3—3 of FIG. 1; and FIG. 4 is a side elevational view of the paint roller with the handle portion removed therefrom.

BEST MODE FOR CARRYING OUT THE INVENTION

Referring now to the drawings wherein like reference numerals designate identical or corresponding parts throughout the several views, FIG. 1 shows a paint roller apparatus (10) constructed in accordance with the present invention. The paint roller apparatus (10) includes a handle (11) which may be made out of wood, and which has a metal rod (12) secured thereto as in a conventional paint roller. A cylindrical member (13) is rotatably attached to the rod (12) along a longitudinal axis (14) in a conventional manner, for example in the manner that the paint roller of U.S. Pat. No. 2,823,402 is constructed.

Referring now to FIG. 4, it is noted that the roller section (15) includes a porous outer surface (16) which can be foam rubber, urethane foam, or rug-like thread fibers, for example. Referring to FIG. 3, it is noted that the roller (15) has a rigid inner cylinder (17) constructed of metal or hard plastic, such as nylon, to support the porous portion (16) thereof.

Annular foam members (18) are likewise glued to rigid backing annular members (19). The annular foam members (18) can be constructed of foam rubber, urethane foam or some other material having similar properties of being porous to hold the paint and soft enough to conform to the shape of a groove into which it is pushed. The rigid annular rings (19) are preferably made of a hard plastic, such as nylon, but may also be made of metal, such as aluminum.

The annular foam members (18) are secured to the annular rings (19), preferably by some type of adhesive. The porous material (16) can be connected to the inner cylindrical member (17) by an adhesive or by any other method that is currently in use in commercial paint rollers.

In operation, the roller (10) shown in FIG. 1 would be place up next to the surface (20) of siding having grooves (21 and 22) therein. If the porous annular members (18) did not line up so as to exactly go into the grooves (21 and 22), then one of the grooves (18) would be placed in the groove (21) while the other porous annular member (18) would be adjusted manually by moving it in the direction of the arrow (23) in FIG. 4 so that it would exactly line up with the groove (22). This is possible because the inner diameter of the annular member (19) is just slightly less than the outer diameter of the porous outer surface (16). This causes the annular members (18 and 19) to be frictionally held in whatever position they are manually placed, but allows them to be manually moved along the surface of the porous outer member (16) in the manner just described. Consequently, the paint roller apparatus shown in FIG. 1 can be used on siding having grooves of different relative spacings. It is also possible to put more of the annular members (18 and 19) onto the surface of the roller (16), if desired.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. Paint roller apparatus comprising:

a handle;

a cylindrical paint roller having a porous outer surface thereon disposed about a longitudinal axis;

means for rotatably attaching said cylindrical paint roller to said handle about said longitudinal axis;

a first porous annular means disposed around and attached to the outer surface of said roller for extending into grooves in a surface being painted, the axis of said annular means corresponding to said longitudinal axis;

a second porous annular means spaced from the first annular means, said second annular means being disposed around and attached to the outer surface of said roller for extending into a second groove in the surface being painted, the axis of said second annular means corresponding to said longitudinal axis; and wherein the first and second annular means include frictional means for attaching the first and said second annular means to said surface for adjusting the relative position of the first and second annular means on the outer surface of said roller.

2. The apparatus of claim 1 wherein said first and second annular means is comprised of foam rubber.

3. The apparatus of claim 2 wherein said frictional means comprises a rigid ring mounting said first and second annular members and made of a material more dense than foam rubber.

* * * * *